US008794491B2

(12) United States Patent
Gould

(10) Patent No.: US 8,794,491 B2
(45) Date of Patent: Aug. 5, 2014

(54) DISPENSING MODULE AND METHOD OF DISPENSING WITH A PNEUMATIC ACTUATOR

(71) Applicant: Nordson Corporation, Westlake, OH (US)

(72) Inventor: Mark A. Gould, Gainesville, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 13/656,814

(22) Filed: Oct. 22, 2012

(65) Prior Publication Data

US 2013/0105525 A1 May 2, 2013

Related U.S. Application Data

(60) Provisional application No. 61/552,503, filed on Oct. 28, 2011.

(51) Int. Cl.

| | |
|---|---|
| ***B67D 3/00*** | (2006.01) |
| ***B05B 1/30*** | (2006.01) |
| ***B05C 5/02*** | (2006.01) |

(52) U.S. Cl.

CPC ..... *B05B 1/3053* (2013.01); *B05C 5/0225* (2013.01)

USPC ..... 222/504; 91/467; 91/459; 251/63.5; 251/56; 137/625.24

(58) Field of Classification Search

USPC ..... 251/56, 63.5; 222/501, 504, 505, 544, 222/559; 91/459, 466, 467; 239/583, 584; 137/625.24, 625.22, 625.21

See application file for complete search history.

(56) References Cited

U.S. PATENT DOCUMENTS

| | | | | |
|---|---|---|---|---|
| 1,411,513 | A * | 4/1922 | Pitt | 239/340 |
| 1,830,697 | A * | 11/1931 | Hartman | 137/208 |
| 2,127,265 | A * | 8/1938 | Martin | 251/129.11 |
| 2,661,724 | A * | 12/1953 | Blenkle | 91/357 |

(Continued)

FOREIGN PATENT DOCUMENTS

| | | |
|---|---|---|
| EP | 0322538 A1 | 7/1989 |
| EP | 1243342 A2 | 9/2002 |

OTHER PUBLICATIONS

Euorpean Patent Office, International Search Report and Written Opinion in PCT Serial No. PCT/US2012/061459, Apr. 11, 2013.

(Continued)

*Primary Examiner* — Paul R Durand
*Assistant Examiner* — Randall Gruby
(74) *Attorney, Agent, or Firm* — Wood, Herron & Evans, L.L.P.

(57) ABSTRACT

An adhesive dispensing module includes a pneumatic actuator for actuating reciprocating movement of a piston on a dispenser valve member. The pneumatic actuator includes a valve element and a pneumatic housing with an inlet chamber, an exhaust chamber, and a piston chamber. The valve element includes a plurality of inlet passages and a plurality of exhaust passages. The valve element rotates from a first position in which the inlet passages deliver pressurized air from the inlet chamber to the piston chamber, to a second position in which the exhaust passages exhaust pressurized air from the piston chamber to the exhaust chamber. The valve element also includes a plurality of fins configured to be driven by an electromagnetic coil to move the valve element.

35 Claims, 9 Drawing Sheets

(56) References Cited

U.S. PATENT DOCUMENTS

| | | | | | |
|---|---|---|---|---|---|
| 2,835,226 | A | * | 5/1958 | Fehlberg | 91/424 |
| 3,180,527 | A | * | 4/1965 | Wasilewski et al. | 222/642 |
| 3,258,835 | A | * | 7/1966 | Boggild et al. | 29/815 |
| 3,285,141 | A | * | 11/1966 | Palmer, Jr. | 91/368 |
| 3,788,561 | A | * | 1/1974 | Vilagi et al. | 239/553.5 |
| 3,967,784 | A | * | 7/1976 | Ammon | 239/583 |
| 4,437,488 | A | * | 3/1984 | Taggart et al. | 137/334 |
| 4,526,341 | A | * | 7/1985 | Thomas | 251/63.5 |
| 4,682,756 | A | * | 7/1987 | Hartwig et al. | 251/63.5 |
| 4,753,375 | A | * | 6/1988 | Takei et al. | 222/447 |
| 5,022,358 | A | * | 6/1991 | Richeson | 123/90.12 |
| 5,048,489 | A | * | 9/1991 | Fischer et al. | 123/467 |
| 5,388,614 | A | * | 2/1995 | Hakamada et al. | 137/625.65 |
| 5,535,919 | A | * | 7/1996 | Ganzer et al. | 222/1 |
| 5,598,973 | A | * | 2/1997 | Weston | 239/75 |
| 5,779,098 | A | * | 7/1998 | Fancher | 222/41 |
| 5,782,410 | A | * | 7/1998 | Weston | 239/63 |
| 5,819,983 | A | * | 10/1998 | White et al. | 222/1 |
| 5,878,992 | A | * | 3/1999 | Edwards et al. | 251/122 |
| 6,060,125 | A | * | 5/2000 | Fujii | 427/8 |
| 6,343,721 | B1 | * | 2/2002 | Breault | 222/399 |
| 6,378,556 | B1 | * | 4/2002 | Fondse | 137/625.48 |
| 6,688,580 | B2 | * | 2/2004 | Jackson et al. | 251/205 |
| 6,736,291 | B1 | * | 5/2004 | Mimura et al. | 222/129 |
| 7,559,487 | B2 | * | 7/2009 | Gressett et al. | 239/1 |
| 7,578,882 | B2 | | 8/2009 | Harris et al. | |
| 7,762,088 | B2 | * | 7/2010 | Fiske et al. | 62/3.64 |
| 2006/0188645 | A1 | * | 8/2006 | Forti et al. | 427/8 |
| 2009/0071974 | A1 | * | 3/2009 | Ikushima | 222/1 |
| 2010/0206917 | A1 | * | 8/2010 | Tudor et al. | 222/559 |
| 2010/0236632 | A1 | * | 9/2010 | Jakobsen | 137/1 |
| 2010/0327074 | A1 | | 12/2010 | Bondeson et al. | |
| 2012/0061426 | A1 | * | 3/2012 | Hogan et al. | 222/504 |
| 2012/0312838 | A1 | * | 12/2012 | Clark et al. | 222/146.5 |

OTHER PUBLICATIONS

The International Bureau of WIPO, International Preliminary Report on Patentability in PCT Serial No. PCT/US2012/061459, May 8, 2014.

* cited by examiner

DISPENSING MODULE AND METHOD OF DISPENSING WITH A PNEUMATIC ACTUATOR

CROSS-REFERENCE TO RELATED APPLICATION

This application claims the priority of Application Ser. No. 61/552,503, filed Oct. 28, 2011, the disclosure of which is hereby incorporated by reference herein.

FIELD OF THE INVENTION

The present invention generally relates to adhesive dispensing modules and methods, and more particularly, to a pneumatic actuator for moving a piston in an adhesive dispensing module.

BACKGROUND

In many adhesive dispensing modules, the flow of adhesive material is controlled by a dispenser valve member that moves between open and closed positions. In these modules, the dispenser valves typically include pistons that are pneumatically actuated to move by pressurized air. It is important that the pistons responsible for controlling the flow of material move quickly and reliably between the open and closed positions. As such, it is desirable to increase the speed and accuracy of these pistons without adding unnecessary parts or expense.

In a typical air-actuated dispensing module, pressurized air is directed into a chamber above the piston in order to force the piston and valve into an open position. The air is evacuated during a return movement of the piston to close the valve. The return movement is generated by various methods, including but not limited to biasing with a return spring and directing pressurized air to the opposite side of the piston. When the air is redirected to the opposite side the piston, the same passages are generally used to deliver air into and out of the piston chamber. Such an arrangement therefore requires the use of a switching solenoid that is capable of reversing air flows. The necessary amount of time to shift the valve between open and closed positions increases as a result of the additional time needed by the solenoid to reverse operation and the additional time necessary to reverse flow in the same passages.

Moreover, the performance of current pneumatically actuated dispensing modules may be hindered by uneven air flow where the pressurized air enters and exits at one side of the piston chamber. The uneven air flow entering the piston chamber takes more time to fully pressurize the piston chamber to force the piston to move. In this regard, the uneven air flow further increases the necessary amount of time to shift the valve between open and closed positions.

There is a need, therefore, for a dispensing module having a pneumatic actuator that addresses one or more of these deficiencies in the field of dispensing modules and reduces the amount of time required to shift a dispenser valve member between open and closed positions.

SUMMARY OF THE INVENTION

According to one embodiment of the invention, an adhesive dispensing module includes a housing with a liquid inlet, a liquid outlet, and a liquid passage communicating between the liquid inlet and liquid outlet. The liquid passage includes a valve seat. The dispensing module also includes a dispenser valve member mounted for movement in the housing relative to the valve seat between open and closed positions. The dispenser valve member also includes a piston. The dispensing module further includes a pneumatic actuator configured to actuate reciprocating movement of the piston and the dispenser valve member between the open and closed positions. The pneumatic actuator includes an air supply inlet, an air exhaust outlet, and a piston chamber receiving the piston. The piston divides the piston chamber into first and second piston chamber portions. The pneumatic actuator also includes a valve element located within the housing and including a first inlet passage and a first exhaust passage. The valve element is moveable from a first position to a second position. In the first position, the first inlet passage communicates with the air supply inlet and the first piston chamber portion to deliver pressurized air into the first piston chamber portion to move the piston. In the second position, the first exhaust passage communicates with the first piston chamber portion and the air exhaust outlet to exhaust pressurized air from the first piston chamber portion.

In one aspect, the valve element includes a plurality of first inlet passages and a plurality of first exhaust passages. Each of the pluralities of first inlet passages and first exhaust passages are generally equally spaced around an inner peripheral surface of the valve element. In another aspect, the valve element includes a second inlet passage and a second exhaust passage. In the first position of the valve element, the second exhaust passage communicates with the second piston chamber portion and the air exhaust outlet to exhaust pressurized air from the second piston chamber portion. In the second position of the valve element, the second inlet passage communicates with the air supply inlet and the second piston chamber portion to deliver pressurized air into the second piston chamber portion to move the piston. The housing may also include a module housing containing the liquid inlet, the liquid outlet, and the liquid passage, and a pneumatic housing containing the air supply inlet, the air exhaust outlet, and the piston chamber.

According to another embodiment, a method of dispensing adhesive uses an adhesive dispensing module having a liquid passage with a valve seat, a dispenser valve member with a piston, a piston chamber, and a pneumatic valve element with a first inlet passage and a first exhaust passage. The method includes receiving a flow of adhesive into the liquid passage from a liquid inlet and receiving a flow of pressurized air from an air supply inlet communicating with the pneumatic valve element. The pneumatic valve element is moved to a first position in which the first inlet passage communicates with the air supply inlet and the piston chamber. This causes flow of pressurized air into the piston chamber to move the piston and the dispenser valve member to an open position. The pneumatic valve element may then be moved to a second position in which the first exhaust passage communicates with the piston chamber and with an air exhaust outlet. This causes flow of pressurized air out of the piston chamber to enable movement of the piston and the dispenser valve to a closed position blocking flow of adhesive through the valve seat.

In one aspect, the pneumatic valve element surrounds the piston chamber and includes a plurality of first inlet passages and first exhaust passages. The method further includes passing pressurized air through the plurality of first inlet passages when the pneumatic valve element is moved to the first position so that the piston chamber is filled with pressurized air flowing in multiple directions into the piston chamber. When the pneumatic valve element is moved to the second position, the pressurized air is passed through the plurality of first exhaust passages so that the piston chamber is exhausted with pressurized air flowing in multiple directions out of the piston chamber. The inlet passages and exhaust passages may be equally spaced around the pneumatic valve element to enable a rapid and uniform flow of pressurized air into and out of the piston chamber.

In another aspect, the pneumatic valve element is rotated between the first and second positions to cause selective communication of the piston chamber with either the air supply inlet or the air exhaust outlet. More specifically, the pneumatic valve element may include at least one fin that interacts with a first electromagnetic coil and a first pole piece when the first electromagnetic coil is actuated into an active operational state. In this regard, the first pole piece can attract or repel at least one of the fins to cause rotation of the pneumatic valve element. The at least one fin may be biased by a spring into one of the first or second positions of the pneumatic valve element, but the actuation of the first electromagnetic coil is configured to overcome these biasing forces. Alternatively, the current could be switched in direction through the first electromagnetic coil to reverse the polarity of the first pole piece, thereby alternatively attracting and repelling a corresponding fin. In another alternative, a second electromagnetic coil and second pole piece are used in alternating fashion with the first electromagnetic coil to rotate the pneumatic valve element between the first and second positions.

In yet another aspect, the piston divides the piston chamber into first and second piston chamber portions. In such embodiments, the pneumatic valve element may also include a second inlet passage and a second exhaust passage. As a result, the method also includes passing pressurized air from the air supply inlet through the second inlet passage to pressurize the second piston chamber portion when the pneumatic valve element is moved to the second position (the first piston chamber portion is exhausted at this time). The method further includes passing pressurized air out of the piston chamber through the second exhaust passage to the air exhaust outlet when the pneumatic valve element is moved to the first position. Thus, the first and second piston chamber portions can be alternatively and simultaneously pressurized and exhausted to speed up the operation and movement of the piston and the dispenser valve member between open and closed positions.

According to another embodiment of the invention, a pneumatic actuator is configured to actuate reciprocating movement of a piston used in an adhesive dispensing module. The actuator includes a housing including a first chamber, a second chamber, and a piston chamber. A valve element located at the piston chamber includes a plurality of first inlet passages and a plurality of first exhaust passages. One of the first and second chambers is an inlet chamber receiving pressurized air and the other is an exhaust chamber for removing pressurized air. The valve element moves between a first position and a second position. In the first position, the plurality of first inlet passages communicates with the inlet chamber and the piston chamber to deliver pressurized air to the piston chamber. In the second position, the plurality of first exhaust passages communicates with the exhaust chamber and the piston chamber to exhaust pressurized air from the piston chamber.

In one aspect, the valve element is ring-shaped and rotates between the first and second positions to selectively deliver or exhaust pressurized air from the piston chamber. The pluralities of first inlet passages and first exhaust passages are each equally spaced around the ring-shaped valve element.

The piston may divide the piston chamber into a lower piston chamber and an upper piston chamber in selective communication with the plurality of first inlet passages and the plurality of first exhaust passages. The valve element further includes a plurality of second inlet passages and a plurality of second exhaust passages. The pluralities of second inlet passages and second exhaust passages are selectively in communication with the lower piston chamber to deliver pressurized air into and out of the lower piston chamber. The pluralities of second inlet passages and second exhaust passages are also equally spaced around the valve element.

In another aspect, the valve element further includes at least one fin projecting outwardly into the second chamber. The actuator includes a first electromagnetic coil and a first pole piece located adjacent the valve element and configured to attract or repel at least one of the fins in an active operating state of the first electromagnetic coil. To this end, the first electromagnetic coil and first pole piece causes rotational movement of the valve element between the first position and the second position.

In another embodiment, a valve element for a pneumatic actuator is configured to actuate reciprocating movement of a piston. The valve element includes a valve body with an inner peripheral surface defining a piston chamber and an outer peripheral surface. The valve element also includes a plurality of first inlet passages extending through the valve body of the valve element and a plurality of first exhaust passages extending through the valve body of the valve element. The valve element moves from a first position to a second position. In the first position, the plurality of first inlet passages communicates with an air supply inlet of the actuator and the piston chamber to deliver pressurized air to the piston chamber. In the second position, the plurality of first exhaust passages communicates with an air exhaust outlet of the actuator and the piston chamber to exhaust pressurized air from the piston chamber.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE ILLUSTRATIVE EMBODIMENTS

Figure 1:
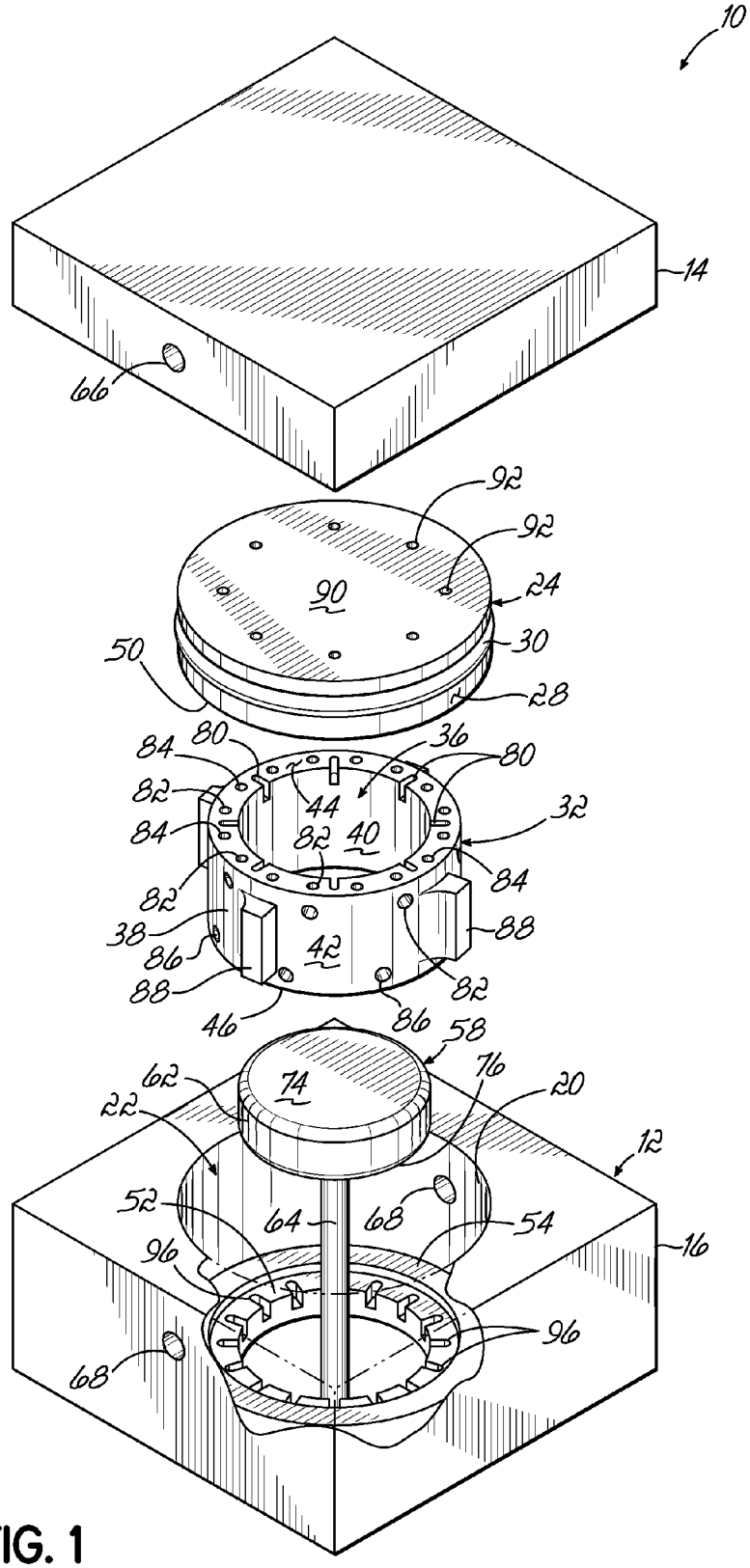
FIG. 1 is an exploded perspective view of an pneumatic actuator according to one embodiment of the current invention.
Figure 2:
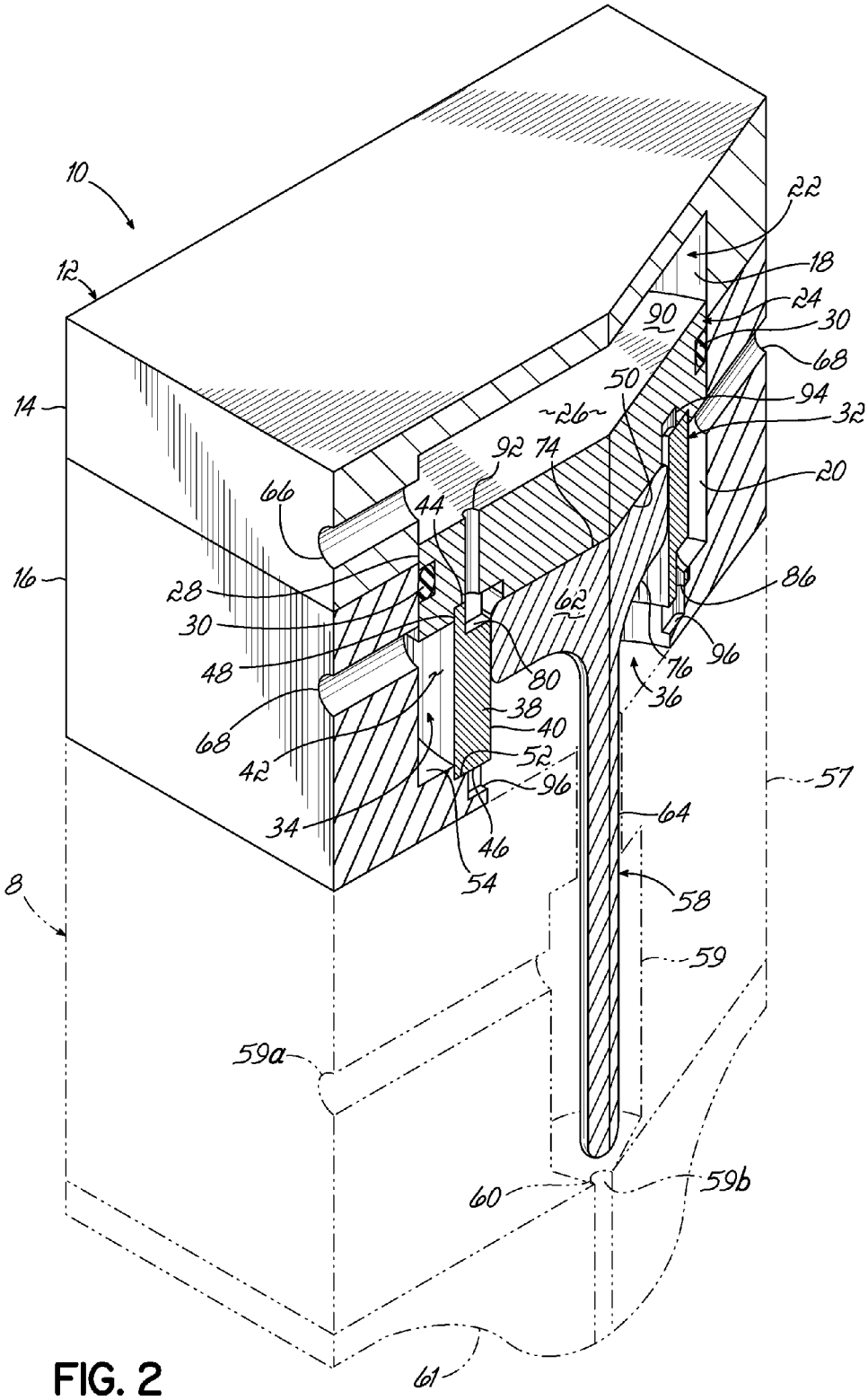
FIG. 2 is a perspective (angled) cross section of the actuator of FIG. 1 on an adhesive dispensing module shown mostly in phantom.

An exemplary embodiment of a dispensing module 8 including a pneumatic actuator 10 in accordance with the invention is illustrated in FIGS. 1-5D. With specific reference to FIGS. 1 and 2, the actuator 10 includes a pneumatic housing 12 having an upper housing portion 14 and a piston housing portion 16. The upper housing portion 14 includes an upper housing bore 18 and the piston housing portion 16 includes a piston housing bore 20 generally aligned with the upper housing bore 18 when the pneumatic housing 12 is assembled as shown in FIG. 2. In this regard, the upper housing bore 18 and the piston housing bore 20 collectively define an interior cavity 22 of the pneumatic housing 12. The interior cavity 22 is shown having a cylindrical shape in the exemplary embodiment, but it will be understood that the cross-sectional shape of the interior cavity 22 may be modified in other embodiments within the scope of this invention. The pneumatic housing 12 may be formed from a relatively lightweight metal material such as aluminum. It will also be understood that directional terms such as upper, lower, top, bottom, etc. are provided for illustrative purposes only as they refer to the orientation of elements shown in FIG. 1, and these directional terms do not limit the actuator 10 to installation in accordance with those directions.

Returning to FIGS. 1 and 2, the actuator 10 also includes a divider wall 24 mounted within and extending across the interior cavity 22. In the exemplary embodiment shown, the divider wall 24 is a seal cap 24. The seal cap 24 divides a first chamber 26 at the upper housing bore 18 from the remainder of the interior cavity 22 (e.g., the piston housing bore 20). In this regard, the seal cap 24 includes a peripheral surface 28 sized to closely engage the interior cavity 22. The seal cap 24 includes an O-ring 30 at the peripheral surface 28 to ensure sealing between the first chamber 26 and the piston housing bore 20. It will be understood that the divider wall/seal cap 24 may alternatively be formed as an integral portion of the pneumatic housing 12 in other embodiments within the scope of the invention. Further details of the seal cap 24 are described in connection with FIG. 4 below.

The actuator 10 also includes a valve element 32 mounted within the piston housing bore 20 of the interior cavity 22. The valve element 32 extends across the piston housing bore 20 to divide the portion of the interior cavity 22 below the seal cap 24 into a second chamber 34 located outside the valve element 32 and a piston chamber 36 located inside the valve element 32. As described in further detail below, one of the first and second chambers 26, 34 is an inlet chamber and the other is an exhaust chamber during operation of the actuator 10. Advantageously, these separate and independent inlet and exhaust chambers 26, 34 provide separate flow paths for inserting and exhausting pressurized air, which increases the overall speed of the actuator 10.

More specifically, the valve element 32 includes a ring-shaped valve body 38 including an inner peripheral surface 40 and an outer peripheral surface 42 extending between an upper end surface 44 and a lower end surface 46. The upper end surface 44 is configured to be received inside a ring-shaped groove 48 formed in a lower surface 50 of the seal cap 24 as shown in FIG. 2. Similarly, the lower end surface 46 is configured to be received by a ring-shaped groove 52 formed in a bottom end 54 of the piston housing portion 16. Thus, the valve element 32 is secured against upward and downward movement by the corresponding ring-shaped grooves 48, 52. Although the valve body 38 and corresponding ring-shaped grooves 48, 52 are cylindrically shaped in the illustrated embodiment, it will be understood that the shape of these elements may be modified in other embodiments of the actuator 10. The valve element 32 is further described with reference to FIGS. 3A and 3B below.

The pneumatic actuator 10 of this embodiment is configured to receive a dispenser valve member 58 associated with the dispensing module 8 (shown in phantom in FIG. 2) for dispensing adhesive material or another liquid material. The dispensing module 8 may be one of any number of types of adhesive dispensing nozzles, including Signature® spray nozzles and SureWrap® nozzles commercially available from Nordson Corporation of Westlake, Ohio. In one example, the dispensing module 8 may be as described in U.S. Patent Publication No. 2010/0327074 to Bondeson et al., the entire disclosure of which is hereby incorporated by reference herein. In another example, the dispensing module 8 may be as described in U.S. Pat. No. 7,578,882 to Harris et al., the entire disclosure of which is hereby incorporated by reference herein. Other types of contact and non-contact dispensing modules may also be used in other embodiments within the scope of this invention.

In the exemplary embodiment shown in FIG. 2, the dispensing module 8 includes a module housing 57 having a liquid passage 59 extending from a liquid inlet 59*a* to a liquid outlet 59*b*. It will be understood that all or a portion of the pneumatic housing 12 may be formed integral with the module housing 57 or attached separately to the module housing 57. The liquid passage 59 includes a valve seat 60 such that the dispenser valve member 58 is adapted to move in a reciprocating manner upward and downward between open and closed positions to thereby open and close flow of adhesive through the valve seat 60 and the liquid outlet 59*b*. As readily understood, the dispensing module 8 may also include a nozzle or die tip 61 for discharging adhesive exiting the liquid outlet 59*b*. The dispenser valve member 58 includes a piston 62 received within the piston chamber 36 and a valve stem 64 extending downwardly from the actuator 10 into the liquid passage 59 of the dispensing module 8. Consequently, the actuator 10 is operable as described in further detail below to drive the reciprocating movement of the dispenser valve member 58 between open and closed positions for adhesive flow by applying pressurized air or another pressurized air on the piston 62 to move the piston 62 within the piston chamber 36. The actuator 10 advantageously provides numerous flow paths into and out of the piston chamber 36 such that the time required to move the dispenser valve member 58 between the open and closed positions is minimized.

With continued reference to FIGS. 1 and 2, the first chamber 26 is an inlet chamber 26 configured to receive a supply of pressurized air in the exemplary embodiment of the actuator 10. In this regard, the upper housing portion 14 further includes at least one air supply inlet 66 communicating with the inlet chamber 26 and adapted to be connected to a pump or other source of pressurized air. In a similar manner, the second chamber 34 of the exemplary embodiment is an exhaust chamber 34 configured to remove pressurized air from the actuator 10. The piston housing portion 16 includes at least one air exhaust outlet 68 communicating with the exhaust chamber 34 and the ambient environment outside the actuator 10. Advantageously, the inlet chamber 26 and the exhaust chamber 34 provide completely separate and independent flow routes for pressurized air entering the piston chamber 36 and pressurized air exiting the piston chamber 36. Although the remainder of the description of the exemplary embodiment continues to describe the first chamber 26 as the inlet chamber 26 and the second chamber 34 as the exhaust chamber 34, it will be appreciated that the first chamber 26 could be used for exhaust and the second chamber 34 used for supply in alternative embodiments of the actuator 10 within the scope of the invention.

As shown in FIG. 2, the piston 62 is sized to be closely received by the valve element 32. To this end, the piston 62 forms a frictional or metallic seal with the inner peripheral surface 40 of the valve body 38. The piston 62 may include a dynamic sealing element (not shown) in some embodiments to engage the inner peripheral surface 40 as the piston 62 reciprocates up and down. The piston 62 therefore divides the piston chamber 36 into an upper piston chamber 70 located above the piston 62 and a lower piston chamber 72 located below the piston 62. The upper piston chamber 70 is bounded by the lower surface 50 of the seal cap 24, a top side 74 of the piston 62, and the inner peripheral surface 40 of the valve body 38. The lower piston chamber 72 is bounded at least partially by a bottom side 76 of the piston 62, the inner peripheral surface 40 of the valve body 38, and the bottom end 54 of the piston housing portion 16. The lower piston chamber 72 may be bounded by a portion of the adhesive dispensing module 8 in the exemplary embodiment illustrated in FIG. 2, but the bottom end 54 of the piston housing portion 16 may alternatively be modified to closely engage the valve stem 64 and fully bound the lower piston chamber 72 in other embodiments of the actuator 10. As described in further detail below, the actuator 10 operates by supplying and exhausting pressurized air to each of the upper piston chamber 70 and the lower piston chamber 72 in an alternating manner.

Figure 3A:
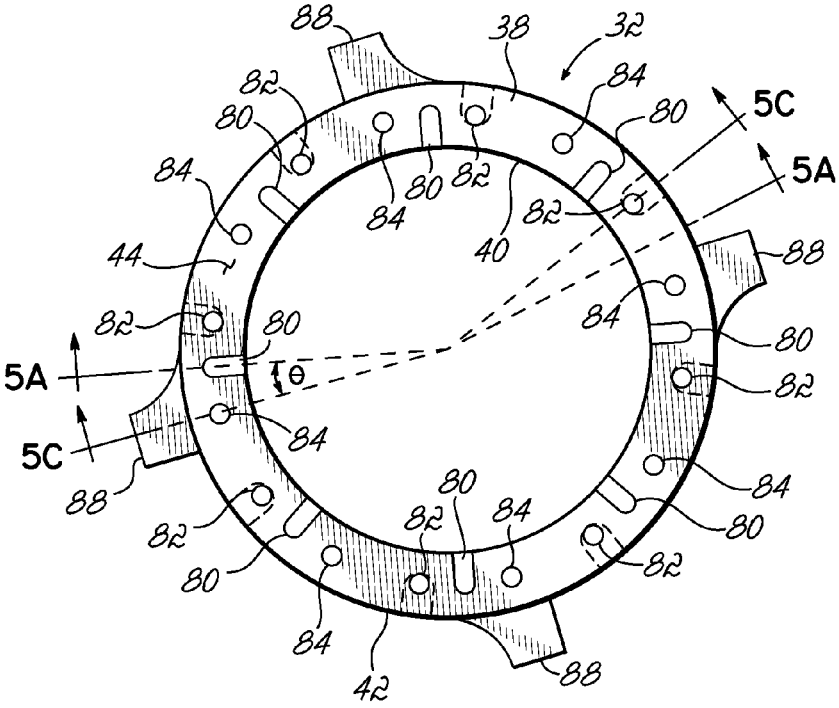
FIG. 3A is a top plan view of the valve element of the actuator of FIG. 1.
Figure 3B:
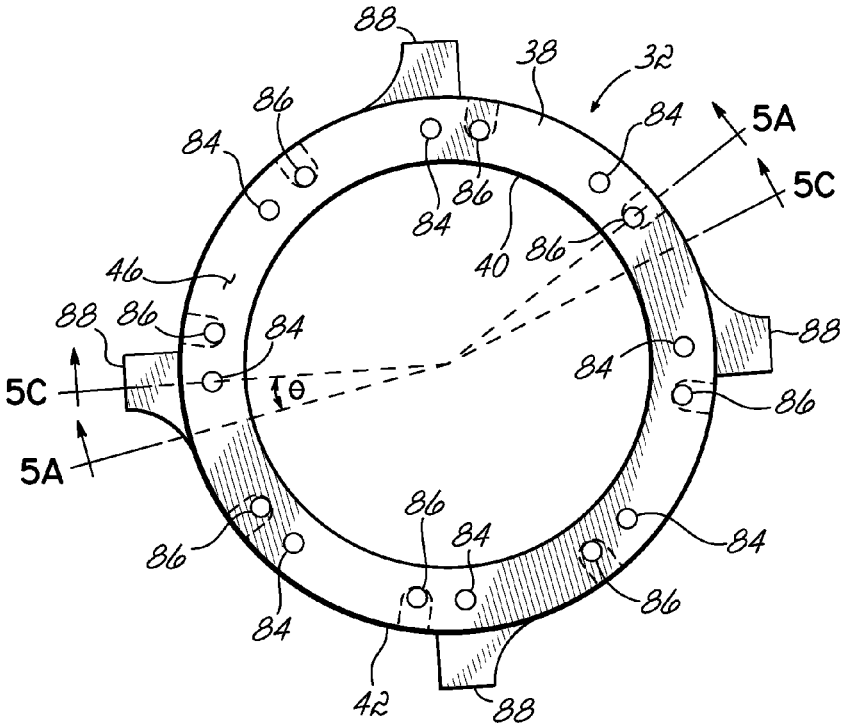
FIG. 3B is a bottom plan view of the valve element of the actuator of FIG. 1.

With reference to FIGS. 3A and 3B, the valve element 32 includes a plurality of passages for directing flow to and from the upper piston chamber 70 and the lower piston chamber 72. More specifically, the valve body 38 includes a plurality of first inlet passages 80 in the form of inlet openings extending from the upper end surface 44 to the inner peripheral surface 40. The plurality of first inlet passages 80 continuously communicates with the upper piston chamber 70 and selectively communicates with the inlet chamber 26 as described in further detail below. Thus, the plurality of first inlet passages 80 delivers pressurized air from the inlet chamber 26 to the upper piston chamber 70.

The valve body 38 also includes a plurality of first exhaust passages 82 extending from the upper end surface 44 to the outer peripheral surface 42. Each of the plurality of first exhaust passages 82 defines an L-shaped bore through the valve body 38 in the exemplary embodiment of the actuator 10. The plurality of first exhaust passages 82 continuously communicates with the exhaust chamber 34 and selectively communicates with the upper piston chamber 70 as described in further detail below. In this regard, the plurality of first exhaust passages 82 removes pressurized air from the upper piston chamber 70 and delivers the air to the exhaust chamber 34.

As shown in FIGS. 3A and 3B, the valve body 38 further includes a plurality of second inlet passages 84 in the form of through-bores extending from the upper end surface 44 to the lower end surface 46. The plurality of second inlet passages 84 selectively communicates with each of the lower piston chamber 72 and the inlet chamber 26 as described in further detail below. Thus, the plurality of second inlet passages 84 delivers pressurized air from the inlet chamber 26 to the lower piston chamber 72. Advantageously, the plurality of second inlet passages 84 captures pressurized air when the second inlet passages 84 are simultaneously brought out of alignment with the lower piston chamber 72 and the inlet chamber 26 as described in further detail below. This capturing of pressurized air reduces the total passage volume that must be pressurized when pressurized air is to be discharged into the lower piston chamber 72.

With reference to FIG. 3B, the valve body 38 also includes a plurality of second exhaust passages 86 extending from the lower end surface 46 to the outer peripheral surface 42. Each of the plurality of second exhaust passages 86 defines an L-shaped bore through the valve body 38 in the exemplary embodiment of the actuator 10. The plurality of second exhaust passages 86 continuously communicates with the exhaust chamber 34 and selectively communicates with the lower piston chamber 72 as described in further detail below. In this regard, the plurality of second exhaust passages 86 removes pressurized air from the lower piston chamber 72 and delivers the air to the exhaust chamber 34. The provision of separate and independent pluralities of inlet passages 80, 84 and exhaust passages 82, 86 advantageously provide separate flow paths for inserting and exhausting pressurized air, which increases the overall speed of the actuator 10.

As shown in FIGS. 3A and 3B, the pluralities of first and second inlet passages 80, 84 and the pluralities of first and second exhaust passages 82. 86 are equally spaced around the valve element 32. For example, the plurality of first inlet passages 80 includes eight first inlet passages 80 spaced from one another by 45 degrees of the ring-shaped valve body 38. Similarly, the plurality of second inlet passages 84 and the pluralities of first and second exhaust passages 82, 86 each include eight corresponding passages/apertures spaced by 45 degree intervals around the valve body 38. Furthermore, each set of first inlet passage 80, first exhaust passage 82, second inlet passage 84, and second exhaust passage 86 is equally spaced from one another such that adjacent passages and apertures 80, 82, 84, 86 are spaced by roughly 11 degree intervals along the entire ring-shaped valve body 38. This generally equivalent spacing is indicated by angle θ in FIGS. 3A and 3B. It will be understood that the total number of inlet passages 80, 84 and exhaust passages 82, 86 may be modified in other embodiments of the actuator 10 within the scope of the invention. Moreover, it will be appreciated that the inlet passages 80, 84 and the exhaust passages 82, 86 may not be equally spaced around the valve element 32 in other embodiments within the scope of the invention.

Each set of first inlet passage 80, first exhaust passage 82, second inlet passage 84, and second exhaust passage 86 is arranged in order as follows: a second inlet passage 84, then a first inlet passage 80, then a first exhaust passage 82, then a second exhaust passage 86. To this end, the pluralities of first and second inlet passages 80, 84 are separated by the angle θ, and the pluralities of first and second exhaust passages 82, 86 are also separated by the same angle θ. Thus, as described in further detail below, the valve element 32 rotates between first and second positions by rotating through an angle of θ to selectively place the various inlet passages 80, 84 and exhaust passages 82, 86 into operative communication with the corresponding inlet and exhaust chambers 26, 34 and the corresponding upper and lower piston chambers 70, 72.

The valve element 32 further includes a plurality of fins 88 projecting radially outwardly from the outer peripheral surface 42 of the valve body 38. Each fin 88 defines a generally rectangular cross-sectional profile, although one or more edges of the fins 88 may be curved as shown in FIGS. 3A and 3B. Each fin 88 terminates before the upper end surface 44 and the lower end surface 46 so that those end surfaces 44, 46 can fit into the corresponding ring-shaped grooves 48, 52 described above. The fins 88 of the exemplary embodiment are also located adjacent the second inlet passages 84, which are in the form of through-bores that do not intersect the outer peripheral surface 42 of the valve body 38 (and thus are not blocked by the presence of the fins 88). Four fins 88 are shown on the valve element 32 of FIGS. 3A and 3B, although it will be understood that more or fewer fins 88 may be provided in other embodiments of the actuator 10.

The plurality of fins 88 extends into the exhaust chamber 34 and is configured to interact with one or more electromagnetic coils (not shown in FIGS. 3A and 3B). To this end, the valve element 32 and the fins 88 are formed from a ceramic or steel material that may be magnetized or may be sensitive to magnetic fields generated by an electromagnetic coil. Therefore, as described in further detail with reference to FIGS. 6, 7A, and 7B below, the fins 88 rotate the valve element 32 through the angle θ between the first and second positions of the valve element 32.

Figure 4:
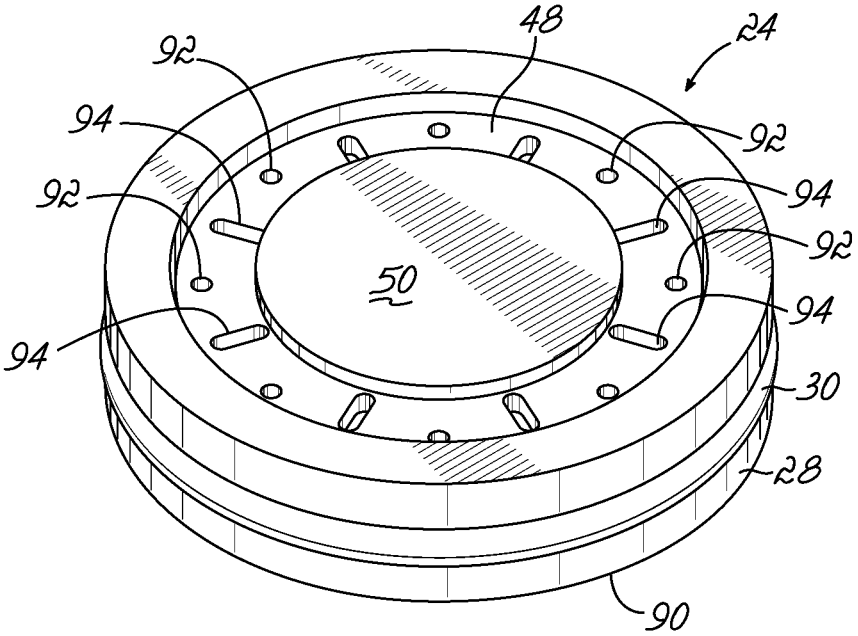
FIG. 4 is a bottom perspective view of the seal cap of the actuator of FIG. 1.

With reference to FIG. 4, the seal cap 24 includes the lower surface 50 and the peripheral surface 28 described above, and an upper surface 90 facing towards the inlet chamber 26. The seal cap 24 includes a plurality of equally spaced inlet bores 92 extending from the upper surface 90 to the ring-shaped groove 48 at the lower surface 50. The number of inlet bores 92 in the seal cap 24 corresponds to the number of first inlet passages 80 and second inlet passages 84 in the valve element 32 (e.g., eight in the exemplary embodiment). Thus, depending on the rotational position of the valve element 32, the plurality of inlet bores 92 may communicate between the inlet chamber 26 and the plurality of first inlet passages 80 or between the inlet chamber 26 and the plurality of second inlet passages 84. The seal cap 24 also includes a plurality of equally spaced exhaust openings 94 at the ring-shaped groove 48. As described in further detail below, the plurality of exhaust openings 94 selectively communicates with the plurality of first exhaust passages 82 depending on the rotational position of the valve element 32. The seal cap 24 of the exemplary embodiment is formed from a plastic or polymer material, but it will be understood that the seal cap 24 may be formed from other materials in other embodiments of the actuator 10.

Figure 5A:
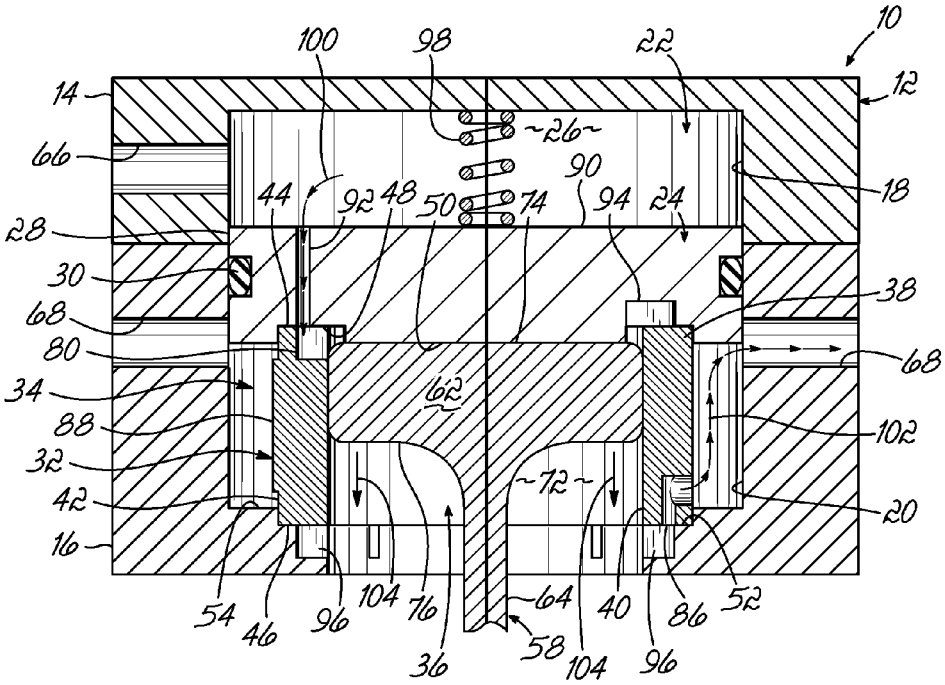
FIG. 5A is a cross-sectional side view of the actuator of FIG. 1 taken along the angled cross section of FIG. 2, showing the valve element in a first position (e.g., the cross-section of the valve element shown in this first position is indicated by line 5A-5A shown in FIGS. 3A and 3B) and a piston in an upper position.
Figure 5B:
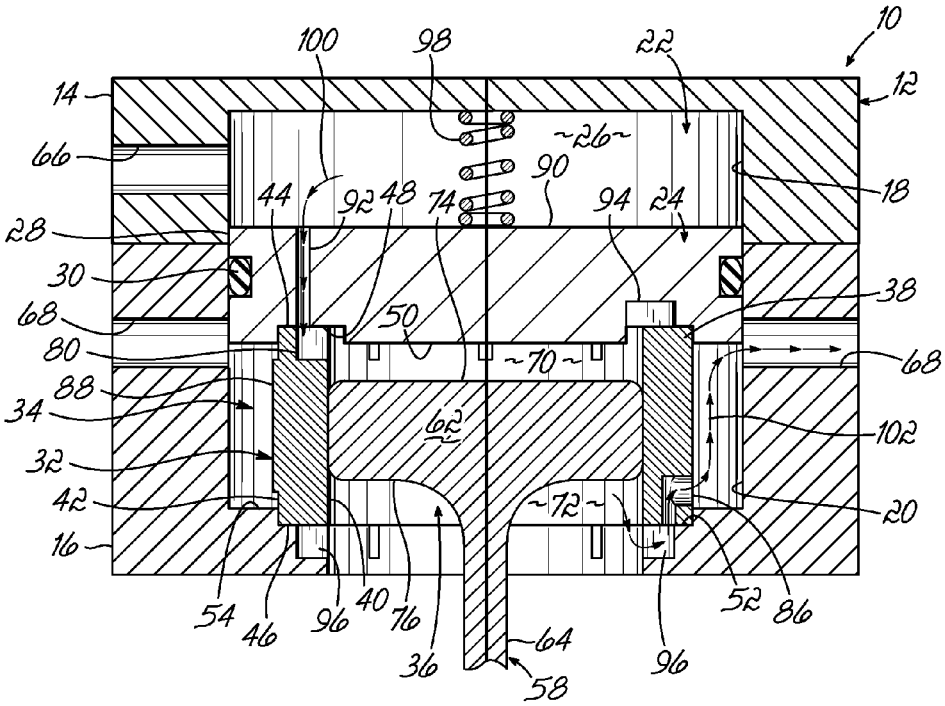
FIG. 5B is a cross-sectional side view of the actuator of FIG. 5A, showing the valve element in the first position and the piston in a lower position.

As shown in FIGS. 1 and 5A, the bottom end 54 of the piston housing portion 16 further includes a plurality of bottom slots 96 located at the ring-shaped groove 52. In this regard, the ring-shaped groove 52 occludes all flow to and from the lower piston chamber 72 through the lower end surface 46 of the valve element 32 except at the plurality of bottom slots 96. The number of bottom slots 96 corresponds to the number of second inlet passages 84 and the number of second exhaust passages 86 in the valve element (e.g., eight in the exemplary embodiment). Depending on the rotational position of the valve element 32, the bottom slots 96 selectively communicate with either the plurality of second inlet passages 84 or the plurality of second exhaust passages 86. Additionally, FIG. 5A illustrates that a spring 98 may be positioned between the upper surface 90 of the seal cap 24 and the housing 12 to bias the seal cap 24 downwardly into continuous engagement with the valve element 32. It will be understood that the spring 98 may be omitted in other embodiments within the scope of the invention.

FIGS. 5A-5D illustrate various operating states of the actuator 10 of the exemplary embodiment. More particularly, the beginning of an operational cycle is shown in FIG. 5A with the piston 62 in an upper or withdrawn position and the valve element 32 in a first position. In this first position of the valve element 32, the plurality of first inlet passages 80 are aligned with the plurality of inlet bores 92 in the seal cap 24. Thus, incoming pressurized air flows as indicated by flow arrows 100 from the inlet chamber 26 through the plurality of inlet bores 92 and the plurality of first inlet passages 80 into the upper piston chamber 70 to press downwardly on the top side 74 of the piston 62. At the same first position, the plurality of second exhaust passages 86 is aligned with the plurality of bottom slots 96 in the ring-shaped groove 52 at the bottom end 54. Thus, pressurized air is also exhausted as shown by flow arrows 102 from the lower piston chamber 72 through the plurality of bottom slots 96, the plurality of second exhaust passages 86, and the exhaust chamber 34 in the first position of the valve element 32. The simultaneous delivery of pressurized air to the upper piston chamber 70 and exhaustion of pressurized air from the lower piston chamber 72 results in a downward movement of the piston 62 shown by arrows 104 from the upper position of FIG. 5A (e.g., an open dispensing position of the dispenser valve member 58) to a lower position of FIG. 5B (e.g., a closed position of the dispenser valve member 58). To this end, the dispenser valve member 58 moves to the lower or extended position so as to cut off adhesive flow through the liquid outlet 59*b* of the dispensing module 8.

Figure 5C:
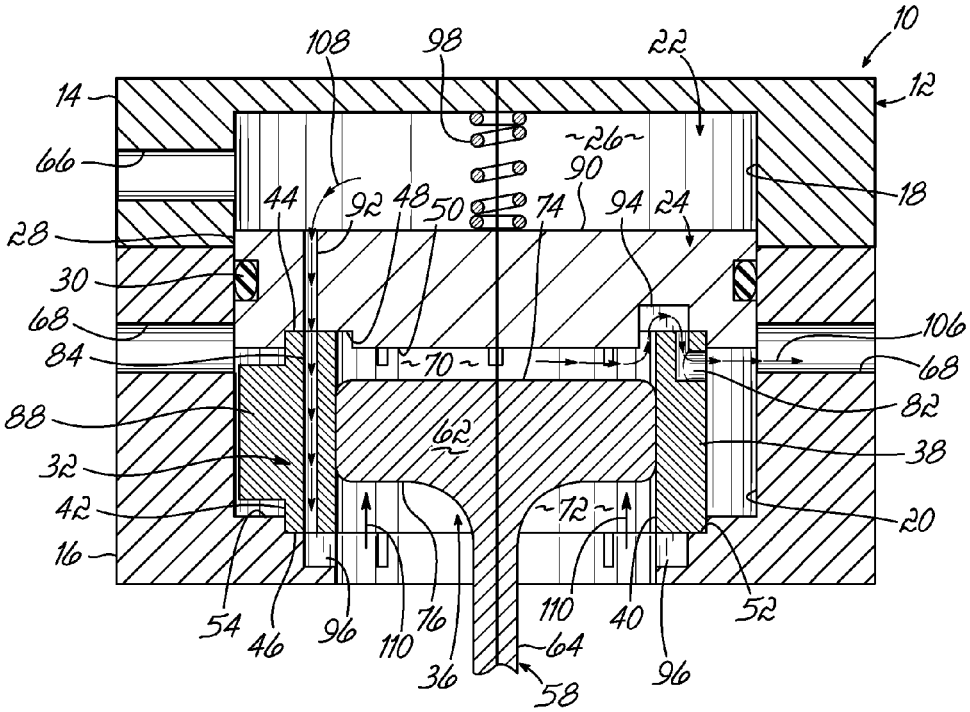
FIG. 5C is a cross-sectional side view of the actuator of FIG. 1 taken along the angled cross section of FIG. 2, showing the valve element in a second position (e.g., the cross-section of the valve element shown in this second position is indicated by line 5C-5C shown in FIGS. 3A and 3B) and the piston in the lower position.
Figure 5D:
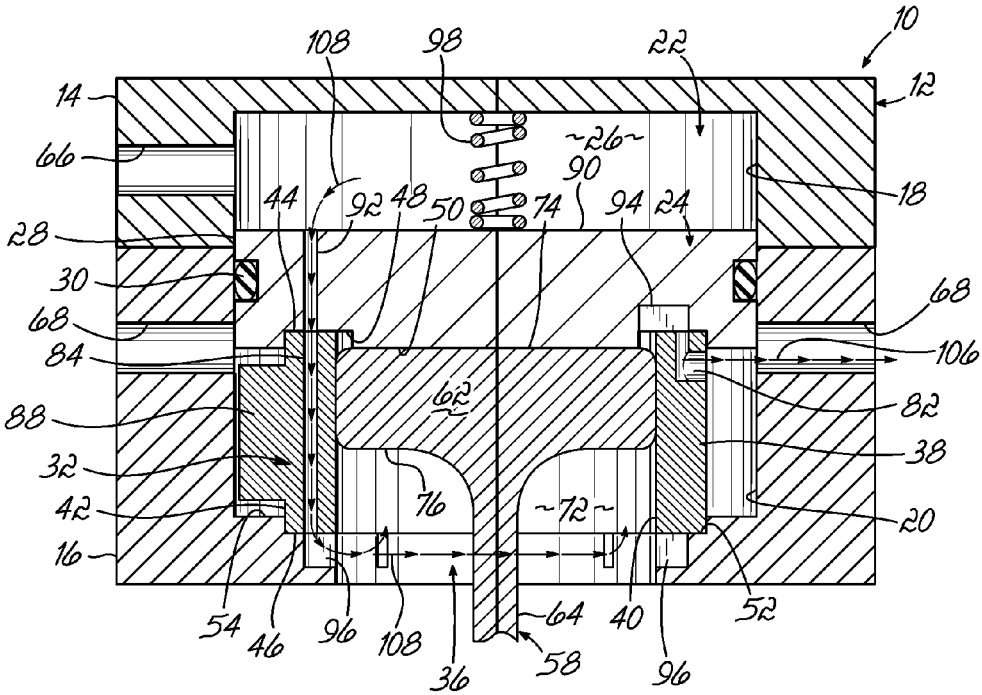
FIG. 5D is a cross-sectional side view of the actuator of FIG. 5C, showing the valve element in the second position and the piston in the upper position.

Then the valve element 32 is rotated through the angle θ to the second position shown in FIGS. 5C and 5D. In this second position of the valve element 32, the plurality of first exhaust passages 82 is aligned with the plurality of exhaust openings 94 in the seal cap 24. Therefore, pressurized air is exhausted from the upper piston chamber 70 as shown by flow arrows 106 through the plurality of exhaust openings 94, the plurality of first exhaust passages 82, and the exhaust chamber 34 in the second position of the valve element 32. At the same second position, the plurality of second inlet passages 84 aligns with the plurality of inlet bores 92 in the seal cap 24 and the plurality of bottom slots 96 in the ring-shaped groove 52 at the bottom end 54. Thus, incoming pressurized air flows as indicated by flow arrows 108 from the inlet chamber 26 through the plurality of inlet bores 92, the plurality of second inlet passages 84, and the plurality of bottom slots 96 into the lower piston chamber 72 to press upwardly on the bottom side 76 of the piston 62. The simultaneous delivery of pressurized air to the lower piston chamber 72 and exhaustion of pressurized air from the upper piston chamber 70 results in an upward movement of the piston 62 shown by arrows 110 from the lower position of FIG. 5C to the upper position of FIG. 5D. To this end, the dispenser valve member 58 moves to the upper or retracted position so as to enable adhesive flow through the liquid outlet 59*b* of the dispensing module 8.

The valve element 32 may then rotate back to the first position to begin the operating cycle again at FIG. 5A. Advantageously, this rotation back to the first position moves the plurality of second inlet passages 84 out of alignment with the inlet bores 92 and the bottom slots 96 simultaneously, which bounds the second inlet passages 84 on either end by the ring-shaped grooves 48, 52. Thus, the remaining pressurized air in the second inlet passage 84 is captured within the second inlet passages 84. This capturing of pressurized air reduces the total passage volume between the inlet chamber 26 and the lower piston chamber 72 that must be pressurized when pressurized air is to be discharged into the lower piston chamber 72, thereby improving the speed of operation of the actuator 10. It will be understood that the second inlet passages 84 may be formed with any length without affecting the response time of the actuator 10 because of this capturing of pressurized air between movements to the second position.

The operating cycle described above with reference to FIGS. 5A-5D evidences the advantageous operation of the pneumatic actuator 10 of this invention. More particularly, pressurized air enters from an inlet chamber 26 that is completely separate from the exhaust chamber 34 that receives exhausted pressurized air. In this regard, pressurized air may be supplied to one side of the piston 62 at the same time pressurized air is exhausted from the other side of the piston 62. More particularly, there is no operating delay caused by switching the flow direction of pressurized air through the same passages and solenoid valves. Moreover, the incoming and outgoing flows of pressurized air from both of the upper piston chamber 70 and the lower piston chamber 72 is directed in all peripheral directions by the pluralities of inlet passages 80, 84 and the pluralities of exhaust passages 82, 86. Thus, the upper and lower piston chambers 70, 72 may be more rapidly filled and exhausted with no uneven flow of pressurized air. In this regard, the dispenser valve member 58 of the dispensing module 8 may be opened and closed more quickly. For at least these reasons, the actuator 10 of the exemplary embodiment minimizes the amount of lag or downtime between operating cycles of the dispenser valve member 58.

Figure 6:
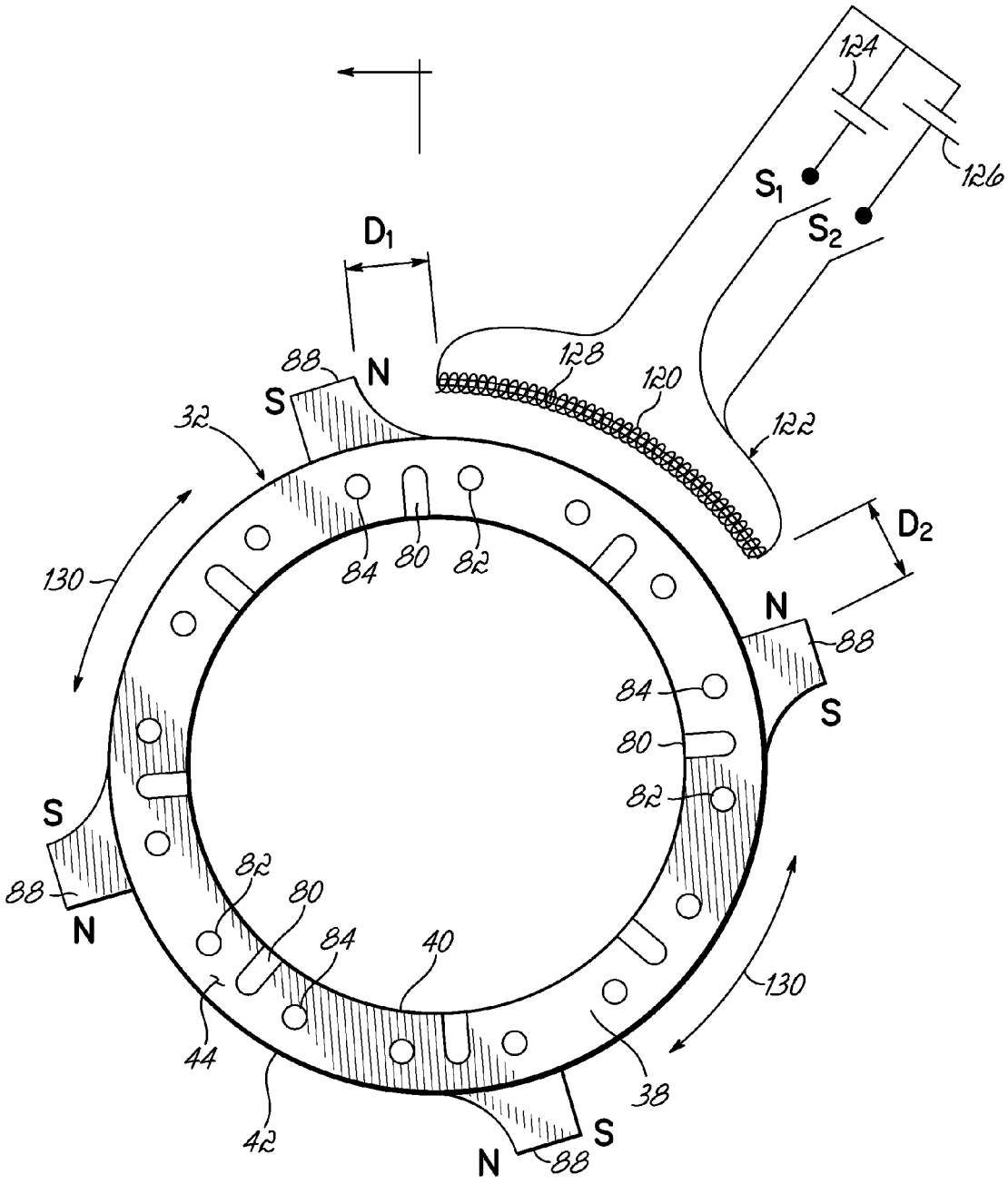
FIG. 6 is a schematic view of the valve element and a reversible polarity electromagnetic actuator in accordance with one embodiment of the actuator.

With reference to FIG. 6, one embodiment of an electromagnetic actuator for moving the valve element 32 between the first position and the second position is shown. In this embodiment, the electromagnetic actuator is at least one electromagnetic coil 120 wrapped around a pole piece 128 located adjacent to the valve element 32. Although not shown in FIG. 6, the electromagnetic coil 120 of this embodiment is located within the exhaust chamber 34 of the actuator 10 or is located in the pneumatic housing 12. The electromagnetic coil 120 is connected to a switchable circuit 122 having two parallel power supplies 124, 126 and two corresponding switches $S_1$, $S_2$ on parallel branches of the circuit 122. The power supplies 124, 126 are oriented opposite to each other so that the current direction through the electromagnetic coil 120 and the magnetic field produced by the electromagnetic coil 120 in the pole piece 128 is reversed depending on which switch $S_1$, $S_2$ is closed.

The fins 88 on the valve element 32 are magnetized in this embodiment so that adjacent fins 88 have opposing polarities. In other words, the pole piece 128 is disposed roughly between two north poles of the fins 88 or two south poles of the fins 88. As a result, when the switchable circuit 122 changes which switch $S_1$, $S_2$ is closed, the pole piece 128 attracts one of the adjacent fins 88 while repelling the other adjacent fin 88. For example, closing the first switch $S_1$ attracts the fin 88 to the left of the pole piece 128 and repels the fin 88 to the right, rotating the valve element 32 in a clockwise direction. Closing the second switch $S_2$ instead repels the fin 88 to the left of the pole piece 128 and attracts the fin 88 to the right, rotating the valve element 32 in a counterclockwise direction. It is well understood that the attraction/repellant force of the pole piece 128 increases as the distance (shown by distances $D_1$ and $D_2$ in FIG. 6) between the end of the pole piece 128 and the corresponding adjacent fin 88 decreases. However, the positioning of the pole piece 128 between two adjacent fins 88 causes the magnetic force applied to one fin 88 to increase relatively proportionally to the amount of decrease in the magnetic force on the other fin 88 as the fins 88 move with the valve element 32, thereby cancelling any reduction of magnetic forces out. Thus, the switchable circuit 122 and electromagnetic coil 120 rapidly and reliably move the valve element 32 between the first and second positions as shown by double-headed arrows 130 and angle θ. It will be understood that more than one electromagnetic coil 120, pole piece 128, and switchable circuit 122 may be provided in other embodiments of the invention.

Figure 7A:
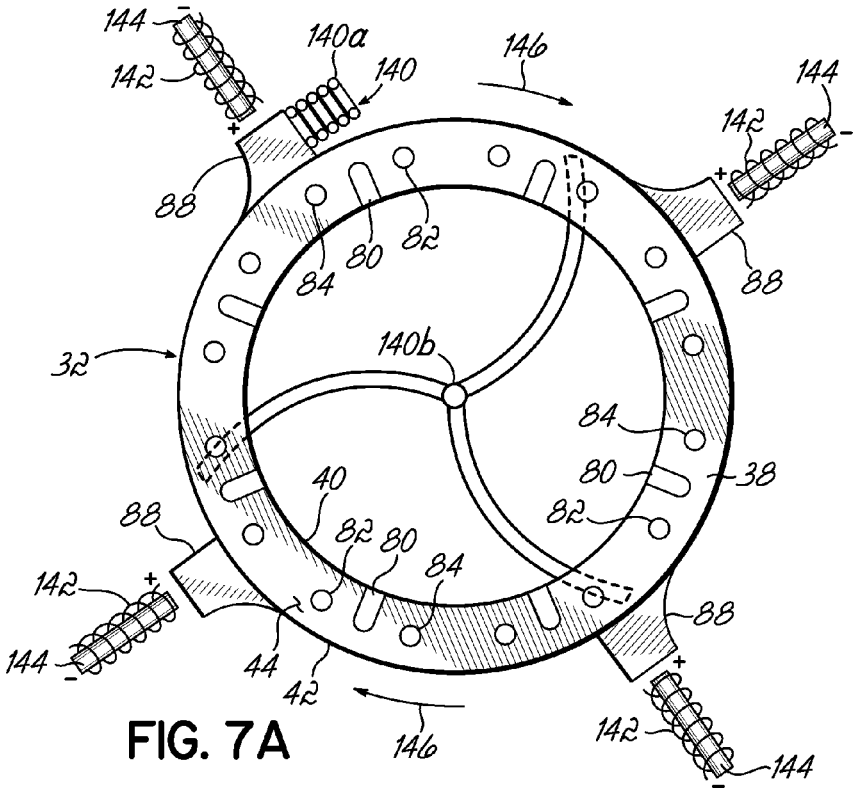
FIG. 7A is a schematic view of the valve element with biasing springs and a set of electromagnetic actuators that are energized to move the valve element against the bias of the springs, in accordance with another embodiment of the actuator.
Figure 7B:
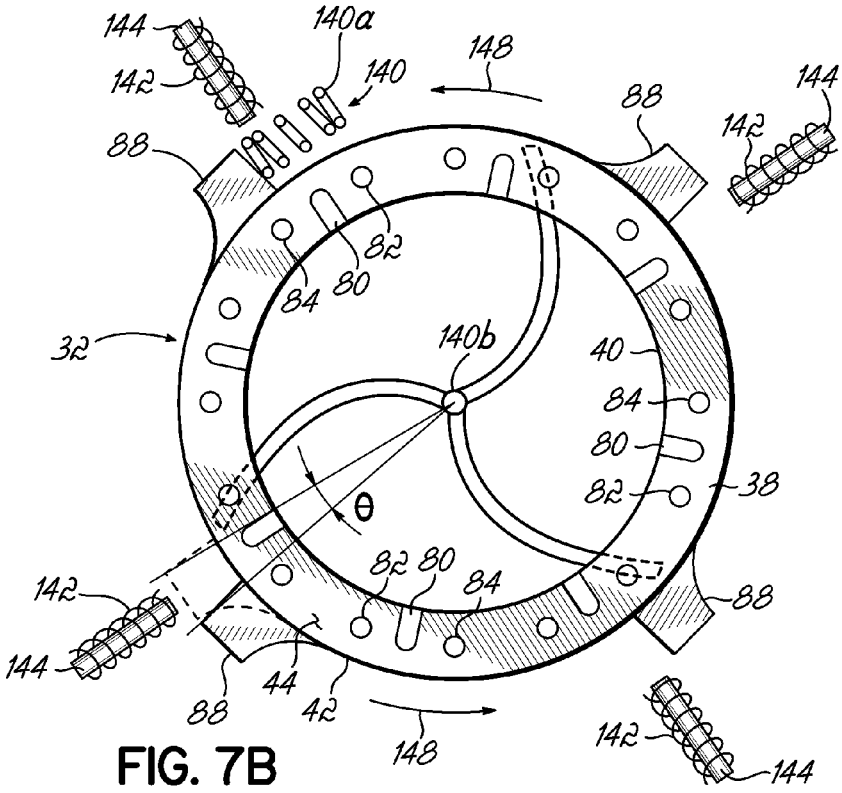
FIG. 7B is a schematic view of the valve element of FIG. 7A, with the electromagnetic actuators not energized.

Alternatively, another embodiment of electromagnetic actuators for moving the valve element 32 is shown in FIGS. 7A and 7B. The electromagnetic actuators of this embodiment include one or more biasing springs 140 engaging the valve element 32 and biasing the valve element 32 towards the first position. The biasing springs 140 may include compression springs 140*a* coupled to the plurality of fins 88 and/or a torsion spring 140*b* coupled to the inner peripheral surface 40 of the valve body 38. In one example, the compression springs 140*a* are located within the exhaust chamber 34 previously described, while the torsion spring 140*b* is within the upper piston chamber 70.

The electromagnetic actuators of this embodiment also include a plurality of electromagnetic coils 142 wrapped around corresponding pole pieces 144 located adjacent to the fins 88 of the valve element 32 as shown in FIGS. 7A and 7B. When the electromagnetic coils 142 are placed into an active operating state by running current through the coils 142, the pole pieces 144 are magnetized so as to attract the fins 88 and force the valve element 32 to rotate clockwise as shown by arrows 146 into the aligned orientation shown in FIG. 7A (e.g., the second position of the valve element 32). When the current stops flowing through the electromagnetic coils 142, the pole pieces 144 stop attracting the fins 88 and the biasing springs 140 push the valve element 32 to rotate counterclockwise as shown by arrows 148 back to the first position. Consequently, the electromagnetic coils 142, pole pieces 144, and biasing springs 140 rapidly and reliably move the valve element 32 between the first and second positions. It will be understood that more or fewer biasing springs 140 and electromagnetic coils 142 may be provided in other embodiments of the invention.

Figure 8A:
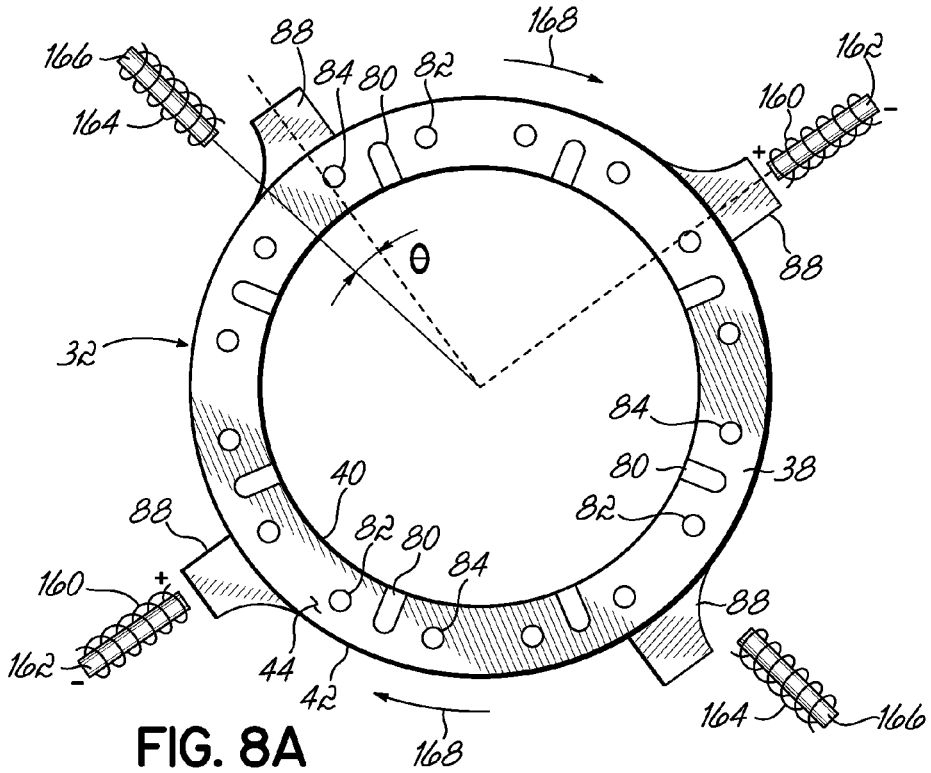
FIG. 8A is a schematic view of the valve element with a first set of electromagnetic actuators that are energized to move the valve element while a second set of electromagnetic actuators is not energized.
Figure 8B:
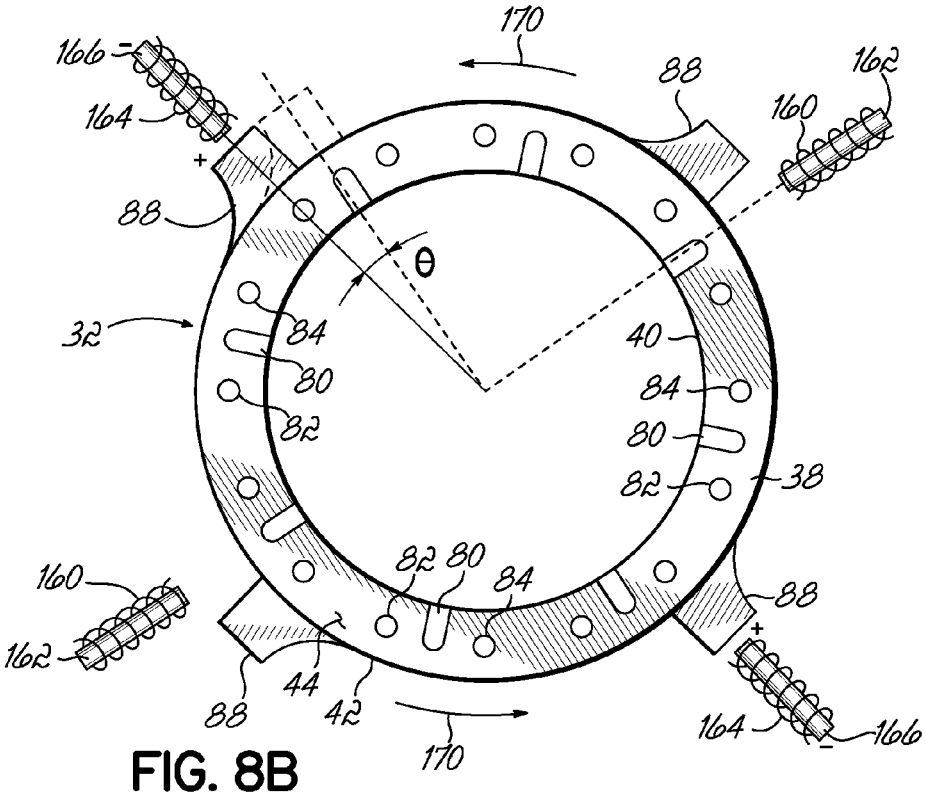
FIG. 8B is a schematic view of the valve element of FIG. 8A, with the first set of electromagnetic actuators not energized and the second set of electromagnetic actuators energized to move the valve element.

Yet another embodiment of electromagnetic actuators for moving the valve element 32 is shown in FIGS. 8A and 8B. The electromagnetic actuators of this embodiment include a pair of first electromagnetic coils 160 wrapped around corresponding first pole pieces 162 and a pair of second electromagnetic coils 164 wrapped around corresponding second pole pieces 166. The first and second electromagnetic coils 160, 164 are configured to be alternatively energized like a stepper motor to alternatively magnetize the first pole pieces 162 and the second pole pieces 166. The first and second pole pieces 162, 166 are located adjacent to the fins 88 as shown in FIGS. 8A and 8B.

When the first electromagnetic coils 160 are placed into an active operating state by running current through the coils 160, the first pole pieces 162 are magnetized so as to attract the adjacent fins 88 and force the valve element 32 to rotate clockwise as shown by arrows 168 into the orientation aligned with the first pole pieces 162 shown in FIG. 8A (e.g., the second position of the valve element 32). The second electromagnetic coils 164 are not energized in this state. When the second electromagnetic coils 164 are energized by running current through them and the first electromagnetic coils 160 are not energized, the second pole pieces 166 are magnetized so as to attract the adjacent fins 88 and force the valve element 32 to rotate counterclockwise as shown by arrows 170 into the orientation aligned with the second pole pieces 166 as shown in FIG. 8B (e.g., the first position of the valve element 32). Consequently, the electromagnetic coils 160, 164 and the pole pieces 162, 166 rapidly and reliably move the valve element 32 between the first and second positions. It will be understood that more or fewer electromagnetic coils 160, 164 and pole pieces 162, 166 may be provided in other embodiments of the invention.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept. What is claimed is:

The invention claimed is:

1. An adhesive dispensing module, comprising:

a housing including a liquid inlet for receiving an adhesive, a liquid outlet for discharging the adhesive, and a liquid passage communicating between the liquid inlet and the liquid outlet, the liquid passage including a valve seat;

a dispenser valve member mounted for movement in the housing relative to the valve seat between open and closed positions, the dispenser valve member including a piston; and a pneumatic actuator configured to actuate reciprocating movement of the piston between the open and closed positions, the pneumatic actuator comprising:

an air supply inlet, an air exhaust outlet, and a piston chamber each positioned within the housing, the piston chamber receiving the piston such that the piston divides the piston chamber into first and second piston chamber portions; and a valve element located within the housing and including a plurality of first inlet passages located at different positions around the piston chamber and a plurality of first exhaust passages located at different positions around the piston chamber, the valve element being moveable from a first position in which the plurality of first inlet passages communicate with the air supply inlet and the first piston chamber portion to deliver pressurized air into the first piston chamber portion to move the piston, and a second position in which the plurality of first exhaust passages communicate with the first piston chamber portion and the air exhaust outlet to exhaust pressurized air from the first piston chamber portion.

2. The adhesive dispensing module of claim 1, wherein the valve element includes an inner peripheral surface surrounding the piston, the plurality of first inlet passages is generally equally spaced around the inner peripheral surface of the valve element, and the plurality of first exhaust passages is generally equally spaced around the inner peripheral surface of the valve element.

3. An adhesive dispensing module, comprising:

a housing including a liquid inlet for receiving an adhesive, a liquid outlet for discharging the adhesive, and a liquid passage communicating between the liquid inlet and the liquid outlet, the liquid passage including a valve seat;

a dispenser valve member mounted for movement in the housing relative to the valve seat between open and closed positions, the dispenser valve member including a piston; and a pneumatic actuator configured to actuate reciprocating movement of the piston between the open and closed positions, the pneumatic actuator comprising:

an air supply inlet, an air exhaust outlet, and a piston chamber each positioned within the housing, the piston chamber receiving the piston such that the piston divides the piston chamber into first and second piston chamber portions; and a valve element located within the housing and including a first inlet passage and a first exhaust passage, the valve element being moveable from a first position in which the first inlet passage communicates with the air supply inlet and the first piston chamber portion to deliver pressurized air into the first piston chamber portion to move the piston, and a second position in which the first exhaust passage communicates with the first piston chamber portion and the air exhaust outlet to exhaust pressurized air from the first piston chamber portion, wherein the valve element further includes a second inlet passage and a second exhaust passage, wherein in the first position of the valve element, the second exhaust passage communicates with the second piston chamber portion and the air exhaust outlet to exhaust pressurized air from the second piston chamber portion, and in the second position of the valve element, the second inlet passage communicates with the air supply inlet and the second piston chamber portion to deliver pressurized air into the second piston chamber portion to move the piston.

4. The adhesive dispensing module of claim 3, wherein the valve element of the pneumatic actuator includes a plurality of first inlet passages, a plurality of first exhaust passages, a plurality of second inlet passages, and a plurality of second exhaust passages.

5. The adhesive dispensing module of claim 4, wherein the valve element includes an inner peripheral surface surrounding the piston, and each of the pluralities of first inlet passages, first exhaust passages, second inlet passages, and second exhaust passages is generally equally spaced around the inner peripheral surface of the valve element.

6. The adhesive dispensing module of claim 1, wherein the housing includes a module housing and a pneumatic housing coupled to the module housing, the module housing having the liquid inlet, the liquid outlet, and the liquid passage, the pneumatic housing including the air supply inlet, the air exhaust outlet, and the piston chamber.

7. A method of dispensing adhesive with an adhesive dispensing module including a liquid passage with a valve seat, a dispenser valve member including a piston and a valve stem, a piston chamber, and a pneumatic valve element surrounding the piston chamber and including a plurality of first inlet passages and a plurality of first exhaust passages, the method comprising:

receiving a flow of adhesive into the liquid passage from a liquid inlet positioned upstream from the valve seat;

receiving a flow of pressurized air at an air supply inlet communicating with the pneumatic valve element;

moving the pneumatic valve element to a first position in which the plurality of first inlet passages communicate with the air supply inlet and with the piston chamber, thereby causing flow of pressurized air into the piston chamber to move the piston and the valve stem to an open position that enables flow of adhesive through the valve seat to a liquid outlet positioned downstream from the valve seat;

passing pressurized air through the plurality of first inlet passages when the pneumatic valve element is moved to the first position such that the piston chamber is filled with pressurized air flowing in multiple directions into the piston chamber;

moving the pneumatic valve element to a second position in which the plurality of first exhaust passages communicate with the piston chamber and with an air exhaust outlet, thereby causing flow of pressurized air out of the piston chamber to enable movement of the piston and the valve stem to a closed position blocking flow of adhesive through the valve seat; and passing pressurized air through the plurality of first exhaust passages when the pneumatic valve element is moved to the second position such that the piston chamber is exhausted with pressurized air flowing in multiple directions out of the piston chamber.

8. The method of claim 7, wherein the plurality of first inlet passages and the plurality of first exhaust passages are each equally spaced about the pneumatic valve element, and the steps of passing pressurized air through the pneumatic valve element further comprise:

actuating a generally uniform flow in all directions into or out of the piston chamber.

9. The method of claim 7, wherein the pneumatic valve element is ring-shaped, and moving the pneumatic valve element to the first or second positions further comprises:

rotating the pneumatic valve element to cause selective communication between the piston chamber and either the air supply inlet or the air exhaust outlet.

10. The method of claim 9, wherein the pneumatic valve element includes at least one fin projecting outwardly away from the piston chamber, the adhesive dispensing module further includes a first electromagnetic coil associated with a first pole piece, and the method further comprises:

actuating the first electromagnetic coil into an active operational state to cause the first pole piece to attract or repel at least one of the fins on the pneumatic valve element, thereby rotating the pneumatic valve element between the first position and the second position.

11. The method of claim 10, wherein the at least one fin is engaged with a biasing spring, and the method further comprises:

biasing the at least one fin with the biasing spring to hold the pneumatic valve element in one of the first and second positions until the active operational state of the first electromagnetic coil is actuated.

12. The method of claim 10, wherein each of the fins on the pneumatic valve element are magnetized, and actuating the first electromagnetic coil further comprises:

reversing a polarity of the first pole piece by switching a current direction in the first electromagnetic coil to rotate the pneumatic valve element.

13. The method of claim 10, wherein the adhesive dispensing module further includes a second electromagnetic coil associated with a second pole piece, and the method further comprises:

actuating the first electromagnetic coil and the second electromagnetic coil in an alternating manner such that the first pole piece and the second pole piece are alternatively magnetized, wherein the first pole piece causes the pneumatic valve element to move to one of the first and second positions when magnetized by the first electromagnetic coil, and the second pole piece causes the pneumatic valve element to move to the other of the first and second positions when magnetized by the second electromagnetic coil.

14. The method of claim 7, wherein the piston divides the piston chamber into first and second piston chamber portions, the pneumatic valve element includes a second inlet passage and a second exhaust passage, and the method further comprises:

passing pressurized air from the air supply inlet through the second inlet passage when the pneumatic valve element is moved to the second position such that the second piston chamber portion is filled with pressurized air; and passing pressurized air through the second exhaust passage to the air exhaust outlet when the pneumatic valve element is moved to the first position such that the second piston chamber portion is exhausted of pressurized air.

15. The method of claim 14, wherein the pneumatic valve element includes a plurality of second inlet passages and a plurality of second exhaust passages, and the method further comprises:

passing pressurized air through the plurality of first inlet passages and the plurality of second exhaust passages when the pneumatic valve element is moved to the first position such that the first piston chamber portion is filled with pressurized air and the second piston chamber portion is exhausted; and passing pressurized air through the plurality of second inlet passages and the plurality of first exhaust passages when the pneumatic valve element is moved to the second position such that the second piston chamber portion is filled with pressurized air and the first piston chamber portion is exhausted.

16. A pneumatic actuator configured to actuate reciprocating movement of a piston used in an adhesive dispensing device, the actuator comprising:

a housing including a piston chamber adapted to receive the piston and first and second chambers separate from the piston chamber, wherein one of the first and second chambers is an inlet chamber receiving pressurized air, and the other of the first and second chambers is an exhaust chamber for removing pressurized air, the piston chamber defining a periphery adapted to surround the piston; and a valve element located at the piston chamber, the valve element including a plurality of first inlet passages located at different positions around the periphery of the piston chamber and a plurality of first exhaust passages located at different positions around the periphery of the piston chamber, wherein the valve element is moveable from a first position in which the plurality of first inlet passages communicates with inlet chamber and the piston chamber to deliver pressurized air into the piston chamber, and a second position in which the plurality of first exhaust passages communicates with the piston chamber and the exhaust chamber to exhaust pressurized air from the piston chamber.

17. The pneumatic actuator of claim 16, wherein the valve element includes an inner peripheral surface surrounding the piston, the plurality of first inlet passages is generally equally spaced around the inner peripheral surface of the valve element, and the plurality of first exhaust passages is generally equally spaced around the inner peripheral surface of the valve element.

18. The pneumatic actuator of claim 17, wherein the valve element is ring-shaped and configured to rotate between the first and second positions to selectively deliver or exhaust pressurized air from the piston chamber.

19. The pneumatic actuator of claim 16, wherein the piston divides the piston chamber into a lower piston chamber portion and an upper piston chamber portion in selective communication with the plurality of first inlet passages and the plurality of first exhaust passages, the valve element further includes a plurality of second inlet passages and a plurality of second exhaust passages, and in the first position of the valve element, the plurality of second exhaust passages communicates with the lower piston chamber portion and the exhaust chamber, and in the second position of the valve element, the plurality of second inlet passages communicates with the inlet chamber and the lower piston chamber portion.

20. The pneumatic actuator of claim 19, wherein the valve element includes an inner peripheral surface surrounding the piston, the pluralities of first and second inlet passages are generally equally spaced around the inner peripheral surface, and the pluralities of first and second exhaust passages are generally equally spaced around the inner peripheral surface.

21. The pneumatic actuator of claim 19, further comprising:

a divider wall separating the piston chamber from the inlet chamber, wherein the valve element divides the piston chamber from the exhaust chamber, the valve element including an inner peripheral surface facing the piston chamber and an outer peripheral surface facing the exhaust chamber.

22. The pneumatic actuator of claim 21, wherein the valve element includes an upper end surface engaging the divider wall, the plurality of first inlet passages extends between the upper end surface and the inner peripheral surface, and the plurality of first exhaust passages extends from the upper end surface to the outer peripheral surface.

23. The pneumatic actuator of claim 22, wherein the valve element includes a lower end surface engaging the housing and including the plurality of second exhaust passages, and the plurality of second inlet passages extends from the upper end surface to the lower end surface.

24. The pneumatic actuator of claim 23, wherein the divider wall includes a plurality of inlet bores communicating with the inlet chamber and a plurality of exhaust openings communicating with the piston chamber, and the valve element rotates between the first and second positions to selectively align either the plurality of first inlet passages with the plurality of inlet bores or the plurality of first exhaust passages with the plurality of exhaust openings.

25. The pneumatic actuator of claim 23, wherein the housing includes a plurality of bottom slots communicating with the lower piston chamber, and the valve element rotates between the first and second positions to selectively align either the plurality of second inlet passages with the plurality of bottom slots or the plurality of second exhaust passages with the plurality of bottom slots.

26. The pneumatic actuator of claim 16, wherein the valve element further includes at least one fin projecting outwardly into the housing, and the pneumatic actuator further comprises:

a first electromagnetic coil and a first pole piece located adjacent the valve element, the first pole piece attracting and/or repelling at least one of the fins on the valve element in an active operating state of the first electromagnetic coil so as to cause rotational movement of the valve element between the first position and the second position.

27. The pneumatic actuator of claim 26, wherein the valve element is biased towards the first position by a spring, and the first pole piece attracts at least one of the fins on the valve element in the active operating state to overcome the spring bias and move the fin into alignment with the first pole piece, thereby rotating the valve element between the first position and the second position.

28. The pneumatic actuator of claim 26, wherein each of the fins on the valve element is magnetized, and the first electromagnetic coil includes a switchable circuit that reverses the polarity of the first pole piece to attract and/or repel a corresponding fin to move the valve element between the first position and the second position when the polarity of the first electromagnetic coil is reversed.

29. The pneumatic actuator of claim 26, further comprising:

a second electromagnetic coil and a second pole piece located adjacent the valve element, the second pole piece attracting and/or repelling at least one of the fins on the valve element in an active operating state of the second electromagnetic coil so as to cause rotational movement of the valve element between the first position and the second position, wherein the first pole piece causes the valve element to move to one of the first and second positions when magnetized by the first electromagnetic coil, and the second pole piece causes the valve element to move to the other of the first and second positions when magnetized by the second electromagnetic coil.

30. A valve element for a pneumatic actuator configured to actuate reciprocating movement of a piston used in an adhesive dispensing module, the pneumatic actuator including a housing with an air supply inlet and an air exhaust outlet, the valve element comprising:

a valve body including an inner peripheral surface defining a piston chamber for receiving the piston and an outer peripheral surface;

a plurality of first inlet passages extending through the valve body; and a plurality of first exhaust passages extending through the valve body, the valve element being moveable within the housing of the pneumatic actuator from a first position in which the plurality of first inlet passages communicates with the air supply inlet and the piston chamber to deliver pressurized air into the piston chamber, to a second position in which the plurality of first exhaust passages communicates with the piston chamber and the air exhaust outlet to exhaust pressurized air from the piston chamber.

31. The valve element of claim 30, wherein the plurality of first inlet passages is generally equally spaced around the valve element, and the plurality of first exhaust passages is generally equally spaced around the valve element.

32. The valve element of claim 30, wherein the piston divides the piston chamber into a lower piston chamber and an upper piston chamber in selective communication with the plurality of first inlet passages and the plurality of first exhaust passages, and the valve element further comprises:

a plurality of second inlet passages extending through the valve body; and a plurality of second exhaust passages extending through the valve body, wherein in the first position of the valve element, the plurality of second exhaust passages communicates with the lower piston chamber and the air exhaust outlet to exhaust pressurized air from the lower piston chamber, and in the second position of the valve element, the plurality of second inlet passages communicates with the air supply inlet and the lower piston chamber to deliver pressurized air into the lower piston chamber.

33. The valve element of claim 32, wherein the pluralities of first and second inlet passages are generally equally spaced around the valve element, and the pluralities of first and second exhaust passages are generally equally spaced around the valve element.

34. The valve element of claim 30, further comprising:

at least one fin projecting outwardly from the outer peripheral surface, at least one of the fins configured to be attracted and/or repelled by an electromagnetic coil and a pole piece to rotate the valve element between the first position and the second position.

35. The valve element of claim 34, wherein each of the plurality of fins is magnetized.

* * * * *